United States Patent [19]

Wilson

[11] 4,060,224

[45] Nov. 29, 1977

[54] MIXING BAR AND SYSTEM

[76] Inventor: William Wilson, 716 Scott St., Stroudsburg, Pa. 18360

[21] Appl. No.: 664,718

[22] Filed: Mar. 8, 1976

[51] Int. Cl.[2] ..... B01F 7/00; B01F 15/02

[52] U.S. Cl. ..... 366/169; 416/142; 366/182

[58] Field of Search ..... 259/106, 99, 103, 111, 259/102, 107, 109, 15, 16, 21, 22, 23, 24, 25, 26; 416/142, 90

[56] References Cited

U.S. PATENT DOCUMENTS

| | | | |
|---|---|---|---|
| 1,057,335 | 3/1913 | Fay | 259/103 |
| 2,336,017 | 12/1943 | Jewell et al. | 259/99 |
| 3,223,389 | 12/1965 | Simmonds | 259/106 |

*Primary Examiner*—Price William
*Assistant Examiner*—Steven M. Pollard
*Attorney, Agent, or Firm*—Stuart E. Beck

[57] ABSTRACT

A hollow mixing bar having at least one blade pivoted at one end by attachment to the mixing bar such that it is designed to rest against the mixing bar until the mixing bar is rotated. As the mixing bar is rotated the unattached end of each blade moves away from the plane of the mixing bar thereby contributing to the blending or decompaction action of the mixing bar. The blade can also protect apertures in the mixing bar used for introduction of fluid materials through the mixing bar and the outlet apertures. The design of the mixing bar is especially advantageous in that it minimizes the initial torque necessary to blend or decompact solids and is readily removable for cleaning. In the preferred embodiment the mixing bar provides a wide range of blending action ranging from gentle vibration to violent agitation.

7 Claims, 5 Drawing Figures

MIXING BAR AND SYSTEM

FIELD OF THE INVENTION

The present invention relates to mixing bars and, more particularly, the present invention relates to an improved mixing bar and system for intermixing controlled amounts of solid-solid, solid-liquid, liquid-liquid or liquid-gas materials.

BACKGROUND OF THE INVENTION

Whether dealing with liquids, solids, gases, or any combination of these phases, the fundamental object to be accomplished by mixing is always the same, namely, to achieve uniformity, i.e., to place each particle of any one material as nearly adjacent as possible to a particle of each of the other materials present. In practice, these results are never obtained and to date there has not been developed any formula or equation that can be used to calculate degree or speed of mixing under a given set of conditions in order to achieve this fundamental objective.

Because of the fact that the mixing art is so empirical, and the almost infinite variety of substances to be mixed, each industry has developed mixing equipment particularly for its own use. Such diversification in mixing equipment is not only unnecessary, but it is the greatest obstacle to sound coordination of knowledge in the mixing art.

In many chemical operations it is desirable to uniformly intermix one material with another within a controlled period of time. In order to achieve this it is advantageous to introduce the added material at or near the point where the most significant mixing action occurs. U.S. Pat. Nos. 146,339; 335,574; and 3,725,193 have suggested controlling the point of addition of one material with another by introducing material through a central stirring member.

Problems known to exist with present mixing equipment include (a) the difficulty of keeping apparatus clean and particularly keeping openings in the stirring members from becoming clogged, (b) the difficulty and time required to remove stirring members having fixed vanes, i.e., extended arms, from mixing containers, (c) the necessity in many cases of conducting mixing operations in equipment designed solely for that purpose, (d) the problem of the substantial initial torque required when attempting to rotate a mixing bar with fixed arms in a dense solid mixture or in material which has a high degree of compaction, (e) the necessity of using different equipment to accomplish gentle agitation, for solids-solids blending, for liquid-solids mixing and for introducing gases into liquids, and (f) the difficulty of regulating the amount and timing of material introduced via a central stirring member.

With the requirement in various industries, such as the pharmaceutical industry and food industry, for mixing materials under conditions which avoid opening a container and exposing its contents to the environment and the necessity in other industries to avoid exposing individuals to the contents of poisonous or otherwise hazardous material, there has been an increasing awareness of the need for improved mixing equipment which can be utilized under such conditions.

SUMMARY OF THE INVENTION

An object of the present invention is to provide an improved mixing bar and system for blending and decompacting materials: including solid-solid, solid-liquid, liquid-liquid and liquid-gas materials.

Another object of the present invention is to provide apparatus capable of providing gentle agitation as well as for blending all phases of material.

Still another object of the present invention is to provide a hollow mixing bar with outlet apertures for passage of material and pivoted blades which cover the outlet apertures when the mixing bar is not being rotated and open or expose the outlet apertures when the mixing bar is rotated.

Yet another object of the present invention is to provide movable blades attached to a mixing bar which vary their direction depending on the speed of rotation.

A still further object of the present invention is to provide a mixing bar which is easily removable.

In accordance with the present invention an improved mixing bar and mixing system are disclosed in which the mixing bar has at least one blade pivotedly attached at one end to the mixing bar such that the blade ordinarily rests against the mixing bar until the mixing bar is rotated. As the mixing bar rotates each blade pivots away from the plane of the mixing bar in a direction perpendicular to the mixing bar. The apparatus permits the introduction of fluid material through a hollow central portion of the mixing bar and out outlet apertures. Each extended blade contributes to the mixing operation and a portion of each blade can sweep an area to facilitate introduction of fluid material through outlet apertures. Since the pivoted blades rest against the mixing bar when the mixing bar is not being rotated, the mixing bar can be removed as a unit through an opening substantially the same size as the mixing bar itself. In one embodiment of the invention, the pivoted blades can be spring-actuated such that they remain in a closed position against the mixing bar until the mixing bar reaches a predetermined speed of rotation. In another preferred embodiment of the invention the mixing bar is rectangular in configuration and provides gentle vibration or agitation even at very slow rotational speeds.

BRIEF DESCRIPTION OF THE DRAWINGS

Other and further objects, advantages and features of the invention will be apparent to those skilled in the art from the following detailed description thereof, taken in conjunction with the accompanying drawings in which.

DESCRIPTION OF THE PREFERRED EMBODIMENTS

Figure 1:
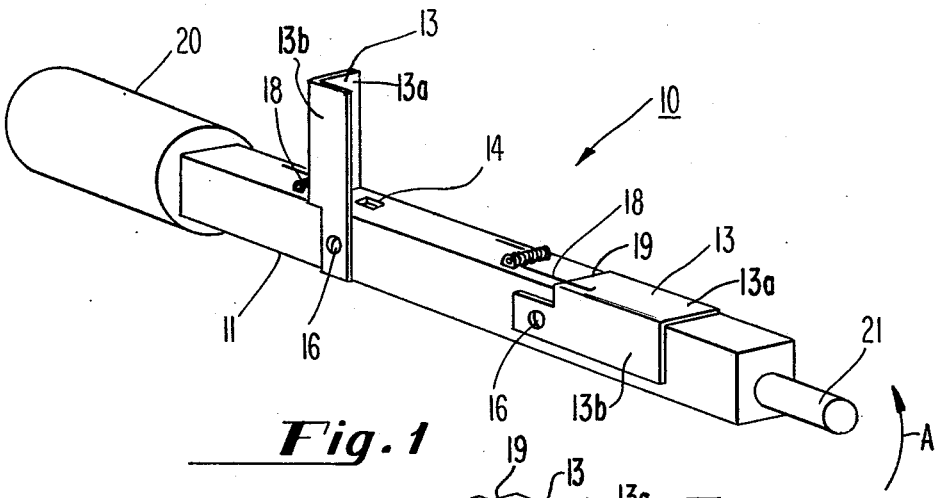
FIG. 1 is a perspective view of an improved mixing bar according to one embodiment of the present invention, illustrating pivotal blades in both an open and closed position.

Referring now to the drawings, an improved mixing bar in accordance with the present invention is illustrated in FIG. 1. Mixing bar 10 comprises an elongated hollow rectangular shaped bar 11 with multiple blades 13—13 pivotally attached to rectangular bar 11 and positioned in relationship to apertures, such as aperture 14 in rectangular bar 11, such that said pivotal blades cover the apertures when the blades rest against rectangular bar 11. The apertures are located in rectangular bar 11 so as to connect to an internal passageway (not shown) in hollow elongated rectangular bar 11. Screws 16—16 can be used as the pivot point for blades 13—13. It will be understood that for convenience of illustration only two pivotal blades are shown in FIG. 1 and both of these blades appear on the same side of the rectangular bar 11.

As indicated above, when the pivotal blades are in their first or down position, i.e., resting against rectangular bar 11, the blades cover apertures in the bar. As rectangular bar 11 is rotated about its axis pivotal blades 13—13 are exposed to acentrifugal or flywheel effect and pivot around screws 16—16 to their second position which is perpendicular to rectangular bar 11 thereby exposing or opening the apertures. This permits the discharge of controlled amounts of fluid material through the hollow rectangular bar 11 and out outlet aperture 14.

In one embodiment pivotal blades 13—13 are maintained in a down position resting against rectangular bar 11 by means of a spring member 18 which applies pressure against the pivotal blade until the centrifugal force generated by rotation of rectangular bar 11 of the mixing bar about its axis becomes sufficiently great to overcome the pressure being applied by spring member 18. Pivotal blades 13—13 illustrated in FIG. 1 are right angle pivotal blades that include first portions **13*a* and second portions 13*b* which are disposed at right angles to each other so that they lie along the side walls of the elongated hollow member. Portion 13*b* of each of the blades are constructed with stops 19 so as to limit their upward movement to a direction which is perpendicular to rectangular bar 11. As rectangular bar 11 is rotated about its axis in the direction indicated by arrow "A" the forward portion 13*b* of each of pivotal blades 13—13 lies in front of and precedes the apertures 14** thereby creating cavities in the material in the container into which the fluid being discharged from the apertures can flow. Thus, material can flow freely from the outlet apertures without their clogging. This is particularly important when the mixing bar is entirely surrounded by material during the mixing operation and it is desired to add another material through apertures in the mixing bar during that mixing operation. Liquid can be introduced by gravity feed or under pressure. The liquid is flung outwardly from the bar as a fine mist or as droplets which wet the ever changing cavity walls created by the plowing or shearing action of the moving blade.

Suitable means such as mechanical seal cartridge 20 which provides a rotary seal for admitting fluid materials from a fluid supply to hollow rectangular bar 11 can be employed at one end of the mixing bar and a similar type of rotary means can be employed at the other end. In FIG. 1 pin 21 is illustrated as a simple bearing member for support of the forward end of rectangular bar 11.

When rotated at slow speeds rectangular bar 11 can cause a turbulence and provide a gentle mixing effect. This is particularly important when it is desired to obtain a gentle mixing of explosive materials, to achieve a nonviolent decompaction or when one desires to simply create a vibrating movement to assist in the discharge of a container.

When blending a solids-solids mixture or attempting to decompact highly compacted solids the design of rectangular bar 11 is important since it minimizes the initial torque required for rotation through the dense material. As higher speeds are achieved the blades pivot outwardly from the moving bar resulting in significant difference in energy requirements compared to a mixing bar having fixed blades. Of course, a mixing bar having fixed blades is not readily removable and is not as capable of the different variations in types of mixing as the mixing bar of the present invention.

Figure 2:
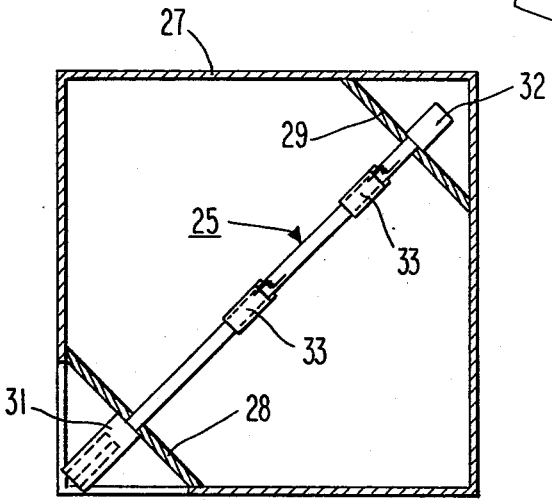
FIG. 2 is a top view, in partial cross section, of a container with mixing bar, such as the mixing bar illustrated in FIG. 1, passing diagonally across the container.

Referring to FIG. 2, mixing bar 25, similar to mixing bar 11 illustrated in FIG. 1, is shown extending diagonally across container 27. Pivotal blades 33—33 are shown resting against mixing bar 25. Brace or support members 28 and 29 are located at two opposite corners of container 27 for retaining mixing bar 25 in position. Conventional bearing means, not shown, permit mixing bar 25 to rotate while sealing the interior of container 27. Auxillary means, not shown, are used to rotate mixing bar 25 and transmit fluid material into end 31. Both ends 31 and 32 of mixing bar 25 remain inside container 27. Access to end 31 can be obtained via a recess in one corner of container 27. Thus, there are no exposed members extending from container 27 which could possibly create a safety problem. Further mixing can be obtained by simultaneously rotating container 27 while rotating mixing bar 25. It will be understood that the shape of the container containing the mixing bar is not material and can be of any suitable shape.

It will be seen that a container, such as container 27, which is designed for transportation and storage of material can be utilized for mixing purposes simply by adaption of the container to contain a mixing bar, such as mixing bar 25. Adaption of containers in this manner eliminates the necessity for transferring material from one container to a specialized container for the purpose of mixing various ingredients or stirring material which has become compacted during shipment. Not only are labor and capital equipment costs thereby reduced, but substantial savings are realized with respect to the time saved in cleaning equipment after each mixing operation. It will also be apparent that further savings can be realized from the fact that one drive station can be utilized with multiple containers. In addition, the design of equipment in accordance with the presen invention permits addition of material and mixing to occur in a closed container. There is no necessity for opening containers to insert mixing equipment. This is particularly important in the pharmaceutical and food industries where contamination is of parameount concern. This feature is also important when dealing with toxic or otherwise dangerous materials.

If it is desired to remove mixing bar 25 from container 27 the fact that pivotal blades 33—33 will normally rest against the mixing bar greatly facilitates removal of the mixing bar through an opening substantially the size of the mixing bar itself.

The fluid material which can be passed through the hollow elongated member of the mixing bar and out through the outlet apertures can be either gaseous, liquid or solid in nature. While gaseous and liquid materials are the normal materials used in the system of the present invention, solid material, especially solid material in particulate form of suitable size for passage through the outlet apertures in the elongated member of the mixing bar, can also be injected in the same manner. The amount of material passed through the mixing bar and out through the apertures can be regulated by (a) the pressure applied to pass the fluid material through the elongated member and by (b) the number and size of the outlet apertures in the elongated member. By temporarily plugging certain outlet apertures the sequence and extent of distribution can be regulated without the necessity of interchanging mixing bars.

Figure 3:
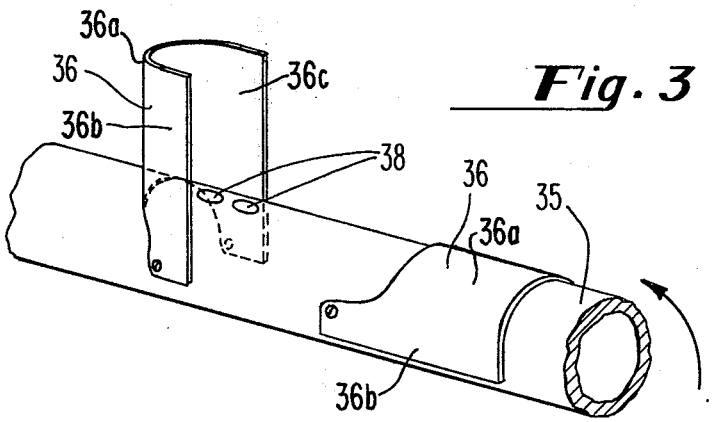
FIG. 3 is a perspective view, partially broken away, of another embodiment of a mixing bar in accordance with the present invention.

The elongated member of the mixing bar can take a variety of shapes. A rectangular or square mixing bar, such as rectangular bar 11, shown in FIG. 1, is a preferred form since the edges of the elongated member create some turbulence when the mixing bar is rotated thereby causing an intermixing of material. Less turbulence results with more rounded configurations of elongated members, such as hollow, elongated member 35 illustrated in FIG. 3. Pivotal blades 36—36 in FIG. 3 match are complementary in shape to the rounded configuration of elongated member 35 and include a portion **36*a* for covering the outlet aperture and a portion 36*b* for preceding the apertures when the hollow, elongated member 35 is rotated about its axis to form cavities in the material being mixed. FIG. 3 also illustrates use of round holes 38—38 rather than slots as the outlet apertures for elongated member 35**. Regardless of the shape of the elongate member, the pivotal blades when extending away from the elongated member, contribute significantly to the intermixing of material.

Figure 5:
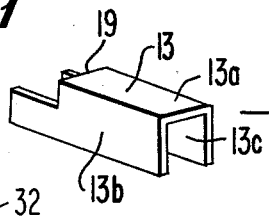
FIG. 5 is a perspective view of another embodiment of a pivotal blade.

Pivotal blades 13—13 of FIG. 1 can be connected to the mixing bar in a manner similar to pivotal blades 36—36 of FIG. 3 by adding another side to pivotal blades 13—13 so as to form a "U" shaped channel which is then connected to the mixing bar on two opposite sides **13*b* and 13*c* (FIG. 5**). Such construction greatly strengthens the pivotal blades, which can be advantageous for solids-solids mixing, such as the mixing of heavy powdered metals. If strength is not a primary consideration and if it is not necessary to cover the apertures, the blades can consist of simply a single flat member.

Figure 4:
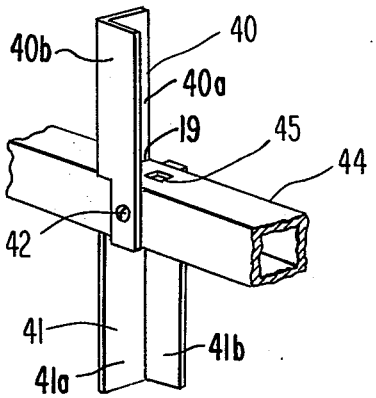
FIG. 4 is a perspective view, partially broken away, of still another embodiment of the present invention in which the pivotal blade is extended to simultaneously cover apertures in opposite sides of the mixing bar.

In FIG. 4 pivotal blades 40 and 41 which are similar in construction to blades 13 extend from pivotal point 42 to cover outlet apertures, such as outlet aperture 45, located on opposite sides of elongated member 44. (Only one of which is shown). Portions **40*a* and 41*a* of blades 40 and 41 act to expose openings in multiple sides when rotation of elongated member 44 about its axis causes pivotal blades 40 and 41 to pivot in opposite directions until they are perpendicular to elongated member 44. Portions 40*b* and 41*b* function in a manner similar to portions 13*b* on blades 13. Spring means, not shown, can be associated with pivotal point 42 to apply gentle pressure against pivotal blades 40 and 41 in order to achieve the same purpose as springs 18—18 in FIG. 1**.

The length, width, shape and angle of the pivotal blades can be varied even on the same mixing bar, provided the blades do not interfere with movement of the mixing bar. For certain limited situation it may also be desirable to have auxiliary mechanical means connected with the pivotal arms to regulate and raising and lowering of the blades. Obviously, other members, such as attached ribs or vanes, can be connected to the mixing bar in a permanent or fixed position if the addition of such auxiliary members are required. If desired, more than one mixing bar can be present in a single container. Moreover, each blade need not be associated with an aperture. If desired, there can be a smaller or a larger number of apertures than blades.

The type of material used to construct mixing bars can be varied and the material used for the pivotal blades need not be the same as that used for the elongate member itself. Any suitble material, including stainless steel, aluminum, plastic, and the like, can be used. Preferably, the materials used will have the characteristics of long wear, minimal weight and will not react with the materials being mixed.

From the foregoing, it will be seen that this invention is well adapted to attain all of the ends and objects hereinabove set forth, together with other advantages which are obvious and inherent. Improved mixing bars and a system for intermixing all phases of materials under controlled conditions varying from simple vibration to violent agitation are provided. The mixing bar apparatus is compact and removable.

Obviously, any modifications and variations of the invention as hereinbefore set forth can be made without departing from the spirit and scope thereof and therefore only such limitations should be imposed as are indicated by the appended claims.

What is claimed is:

1. A mixing bar comprising a hollow elongated member which is rotatable about its axis, means for coupling the interior of said bar to a supply of fluid, at least one aperture in said member for permitting said fluid to be discharged from said member, at least one blade, means for pivotally connecting said blade to said elongated member so that it can pivot between a first position in which it covers said aperture and a second position in which said aperture is uncovered and fluid is discharged from said aperture, and said blade is moved toward said second position when said member is rotated.

2. The mixing bar of claim 1 wherein said elongated member is rectangular in cross section and said blade includes a portion which is disposed in front of said aperture when said blade is in said second position and said elongated bar is rotated.

3. The mixing bar of claim 1 wherein said elongated member is round in cross section and said blade has a complementary rounded shape so that when it is in said first position it lies along said elongated member and closes said aperture, and said blade includes a portion which is disposed in front of said aperture when said blade is in said second position and said elongated member is rotated.

4. The mixing bar of claim 1 including means coupled to each of said blades for urging them toward their first position so that said blades move away from said first position after said elongated member reaches a predetermined speed of rotation.

5. The mixing bar of claim 1 in which each aperture comprises a slotted opening.

6. The mixing bar of claim 1 in which each aperture comprises a round hole.

7. A system for intermixing materials which comprises the steps of providing a container with a first material therein, providing a hollow elongated member in said container which is connectable to a supply of a second material, said hollow elongated member being provided with at least one aperture and at least one blade which is pivotally connected to said elongated hollow member for movement between a first position in which they close said apertures and a second position in which said blades do not close said apertures, rotating said hollow elongated member about its axis at a speed sufficient to cause said blades to move away from their first position so that said apertures are uncovered, and passing a second material through said hollow elongated member and out of said apertures and into cavities in the first material created by rotation of the blades about said axis thereby causing the second material to become intermixed with said first material.

* * * * *